US007703903B2

(12) United States Patent
Tsai et al.

(10) Patent No.: US 7,703,903 B2
(45) Date of Patent: Apr. 27, 2010

(54) INK RESERVOIR FOR INKJET PRINTHEAD

(75) Inventors: Wen-Yuan Tsai, Taipai (CN); Akira Nakazawa, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 852 days.

(21) Appl. No.: 11/482,978

(22) Filed: Jul. 10, 2006

(65) Prior Publication Data

US 2008/0007601 A1 Jan. 10, 2008

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | |
|---|---|---|---|---|
| 5,216,450 | A * | 6/1993 | Koitabashi et al. | 347/87 |
| 6,000,788 | A * | 12/1999 | Iida | 347/86 |
| 6,467,890 | B1 * | 10/2002 | Tajima et al. | 347/87 |
| 6,726,315 | B2 * | 4/2004 | Koizumi et al. | 347/85 |
| 6,951,387 | B2 * | 10/2005 | Carrese et al. | 347/86 |
| 2003/0025773 | A1 | 2/2003 | Koizumi et al. | |
| 2004/0080590 | A1 | 4/2004 | Jung et al. | |

FOREIGN PATENT DOCUMENTS

JP 09-109397 A 4/1997

* cited by examiner

*Primary Examiner*—Anh T. N. Vo

(57) ABSTRACT

An ink reservoir (1) for maintaining ink (10) at a negative pressure by using the suction provided the printhead and then regulating the negative pressure with a pressure regulator (16) that allows air into cartridge at a specified pressure difference. The pressure regulator may be a porous member such as a membrane or mesh filter, or a simple pressure relief valve. The membrane (16), mesh or foam is selected such that its bubble point equates to the specified pressure difference.

18 Claims, 6 Drawing Sheets

INK RESERVOIR FOR INKJET PRINTHEAD

FIELD OF THE INVENTION

The present invention relates to inkjet printers. In particular, the invention relates to the supply of ink to inkjet printheads.

CO-PENDING APPLICATIONS

The following applications have been filed by the Applicant simultaneously with the present application:

| | | | | |
|---|---|---|---|---|
| 7,637,588 | 11/482,970 | 11/482,968 | 7,607,755 | 11/482,971 |
| 11/482,969 | 7,530,663 | 7,467,846 | 11/482,962 | 11/482,963 |
| 11/482,956 | 11/482,954 | 11/482,974 | 11/482,974 | 11/482,987 |

-continued

| | | | | |
|---|---|---|---|---|
| 11/482,959 | 11/482,960 | 11/482,961 | 11/482,964 | 11/482,965 |
| 7,510,261 | 11/482,973 | 11/482,982 | 7,637,602 | 11/482,984 |
| 7,530,446 | 11/482,990 | 11/482,986 | 11/482,985 | 11/482,967 |
| 11/482,966 | 11/482,988 | 11/482,989 | 11/482,980 | 7,571,906 |
| 11/482,953 | 11/482,977 | | | |

The disclosures of these co-pending applications are incorporated herein by reference.

CROSS REFERENCE TO RELATED APPLICATIONS

Various methods, systems and apparatus relating to the present invention are disclosed in the following U.S. patents/patent applications filed by the applicant or assignee of the present invention:

| | | | | | | |
|---|---|---|---|---|---|---|
| 09/517,539 | 6,566,858 | 6,331,946 | 6,246,970 | 6,442,525 | 09/517,384 | 09/505,951 |
| 6,374,354 | 09/517,608 | 6,816,968 | 6,757,832 | 6,334,190 | 6,745,331 | 09/517,541 |
| 10/203,559 | 10/203,560 | 10/203,564 | 10/636,263 | 10/636,283 | 10/866,608 | 10/902,889 |
| 10/902,833 | 10/940,653 | 10/942,858 | 10/727,181 | 10/727,162 | 10/727,163 | 10/727,245 |
| 10/727,204 | 10/727,233 | 10/727,280 | 10/727,157 | 10/727,178 | 10/727,210 | 10/727,257 |
| 10/727,238 | 10/727,251 | 10/727,159 | 10/727,180 | 10/727,179 | 10/727,192 | 10/727,274 |
| 10/727,164 | 10/727,161 | 10/727,198 | 10/727,158 | 10/754,536 | 10/754,938 | 10/727,227 |
| 10/727,160 | 10/934,720 | 11/212,702 | 11/272,491 | 10/296,522 | 6,795,215 | 10/296,535 |
| 09/575,109 | 6,805,419 | 6,859,289 | 6,977,751 | 6,398,332 | 6,394,573 | 6,622,923 |
| 6,747,760 | 6,921,144 | 10/884,881 | 10/943,941 | 10/949,294 | 11/039,866 | 11/123,011 |
| 6,986,560 | 7,008,033 | 11/148,237 | 11/248,435 | 11/248,426 | 10/922,846 | 10/922,845 |
| 10/854,521 | 10/854,522 | 10/854,488 | 10/854,487 | 10/854,503 | 10/854,504 | 10/854,509 |
| 10/854,510 | 10/854,496 | 10/854,497 | 10/854,495 | 10/854,498 | 10/854,511 | 10/854,512 |
| 10/854,525 | 10/854,526 | 10/854,516 | 10/854,508 | 10/854,507 | 10/854,515 | 10/854,506 |
| 10/854,505 | 10/854,493 | 10/854,494 | 10/854,489 | 10/854,490 | 10/854,492 | 10/854,491 |
| 10/854,528 | 10/854,523 | 10/854,527 | 10/854,524 | 10/854,520 | 10/854,514 | 10/854,519 |
| 10/854,513 | 10/854,499 | 10/854,501 | 10/854,500 | 10/854,502 | 10/854,518 | 10/854,517 |
| 10/934,628 | 11/212,823 | 10/728,804 | 10/728,952 | 10/728,806 | 6,991,322 | 10/728,790 |
| 10/728,884 | 10/728,970 | 10/728,784 | 10/728,783 | 10/728,925 | 6,962,402 | 10/728,803 |
| 10/728,780 | 10/728,779 | 10/773,189 | 10/773,204 | 10/773,198 | 10/773,199 | 6,830,318 |
| 10/773,201 | 10/773,191 | 10/773,183 | 10/773,195 | 10/773,196 | 10/773,186 | 10/773,200 |
| 10/773,185 | 10/773,192 | 10/773,197 | 10/773,203 | 10/773,187 | 10/773,202 | 10/773,188 |
| 10/773,194 | 10/773,193 | 10/773,184 | 11/008,118 | 11/060,751 | 11/060,805 | 11/188,017 |
| 11/298,773 | 11/298,774 | 11/329,157 | 6,623,101 | 6,406,129 | 6,505,916 | 6,457,809 |
| 6,550,895 | 6,457,812 | 10/296,434 | 6,428,133 | 6,746,105 | 10/407,212 | 10/407,207 |
| 10/683,064 | 10/683,041 | 6,750,901 | 6,476,863 | 6,788,336 | 11/097,308 | 11/097,309 |
| 11/097,335 | 11/097,299 | 11/097,310 | 11/097,213 | 11/210,687 | 11/097,212 | 11/212,637 |
| 11/246,687 | 11/246,718 | 11/246,685 | 11/246,686 | 11/246,703 | 11/246,691 | 11/246,711 |
| 11/246,690 | 11/246,712 | 11/246,717 | 11/246,709 | 11/246,700 | 11/246,701 | 11/246,702 |
| 11/246,668 | 11/246,697 | 11/246,698 | 11/246,699 | 11/246,675 | 11/246,674 | 11/246,667 |
| 11/246,684 | 11/246,672 | 11/246,673 | 11/246,683 | 11/246,682 | 10/760,272 | 10/760,273 |
| 10/760,187 | 10/760,182 | 10/760,188 | 10/760,218 | 10/760,217 | 10/760,216 | 10/760,233 |
| 10/760,246 | 10/760,212 | 10/760,243 | 10/760,201 | 10/760,185 | 10/760,253 | 10/760,255 |
| 10/760,209 | 10/760,208 | 10/760,194 | 10/760,238 | 10/760,234 | 10/760,235 | 10/760,183 |
| 10/760,189 | 10/760,262 | 10/760,232 | 10/760,231 | 10/760,200 | 10/760,190 | 10/760,191 |
| 10/760,227 | 10/760,207 | 10/760,181 | 10/815,625 | 10/815,624 | 10/815,628 | 10/913,375 |
| 10/913,373 | 10/913,374 | 10/913,372 | 10/913,377 | 10/913,378 | 10/913,380 | 10/913,379 |
| 10/913,376 | 10/913,381 | 10/986,402 | 11/172,816 | 11/172,815 | 11/172,814 | 11/003,786 |
| 11/003,616 | 11/003,418 | 11/003,334 | 11/003,600 | 11/003,404 | 11/003,419 | 11/003,700 |
| 11/003,601 | 11/003,618 | 11/003,615 | 11/003,337 | 11/003,698 | 11/003,420 | 6,984,017 |
| 11/003,699 | 11/071,473 | 11/003,463 | 11/003,701 | 11/003,683 | 11/003,614 | 11/003,702 |
| 11/003,684 | 11/003,619 | 11/003,617 | 11/293,800 | 11/293,802 | 11/293,801 | 11/293,808 |
| 11/293,809 | 11/246,676 | 11/246,677 | 11/246,678 | 11/246,679 | 11/246,680 | 11/246,681 |
| 11/246,714 | 11/246,713 | 11/246,689 | 11/246,671 | 11/246,670 | 11/246,669 | 11/246,704 |
| 11/246,710 | 11/246,688 | 11/246,716 | 11/246,715 | 11/246,707 | 11/246,706 | 11/246,705 |
| 11/246,708 | 11/246,693 | 11/246,692 | 11/246,696 | 11/246,695 | 11/246,694 | 11/293,832 |
| 11/293,838 | 11/293,825 | 11/293,841 | 11/293,799 | 11/293,796 | 11/293,797 | 11/293,798 |
| 10/760,254 | 10/760,210 | 10/760,202 | 10/760,197 | 10/760,198 | 10/760,249 | 10/760,263 |
| 10/760,196 | 10/760,247 | 10/760,223 | 10/760,264 | 10/760,244 | 10/760,245 | 10/760,222 |
| 10/760,248 | 10/760,236 | 10/760,192 | 10/760,203 | 10/760,204 | 10/760,205 | 10/760,206 |
| 10/760,267 | 10/760,270 | 10/760,259 | 10/760,271 | 10/760,275 | 10/760,274 | 10/760,268 |
| 10/760,184 | 10/760,195 | 10/760,186 | 10/760,261 | 10/760,258 | 11/293,804 | 11/293,840 |
| 11/293,803 | 11/293,833 | 11/293,834 | 11/293,835 | 11/293,836 | 11/293,837 | 11/293,792 |
| 11/293,794 | 11/293,839 | 11/293,826 | 11/293,829 | 11/293,830 | 11/293,827 | 11/293,828 |
| 11/293,795 | 11/293,823 | 11/293,824 | 11/293,831 | 11/293,815 | 11/293,819 | 11/293,818 |

-continued

| | | | | | | |
|---|---|---|---|---|---|---|
| 11/293,817 | 11/293,816 | 11/014,764 | 11/014,763 | 11/014,748 | 11/014,747 | 11/014,761 |
| 11/014,760 | 11/014,757 | 11/014,714 | 11/014,713 | 11/014,762 | 11/014,724 | 11/014,723 |
| 11/014,756 | 11/014,736 | 11/014,759 | 11/014,758 | 11/014,725 | 11/014,739 | 11/014,738 |
| 11/014,737 | 11/014,726 | 11/014,745 | 11/014,712 | 11/014,715 | 11/014,751 | 11/014,735 |
| 11/014,734 | 11/014,719 | 11/014,750 | 11/014,749 | 11/014,746 | 11/014,769 | 11/014,729 |
| 11/014,743 | 11/014,733 | 11/014,754 | 11/014,755 | 11/014,765 | 11/014,766 | 11/014,740 |
| 11/014,720 | 11/014,753 | 11/014,752 | 11/014,744 | 11/014,741 | 11/014,768 | 11/014,767 |
| 11/014,718 | 11/014,717 | 11/014,716 | 11/014,732 | 11/014,742 | 11/097,268 | 11/097,185 |
| 11/097,184 | 11/293,820 | 11/293,813 | 11/293,822 | 11/293,812 | 11/293,821 | 11/293,814 |
| 11/293,793 | 11/293,842 | 11/293,811 | 11/293,807 | 11/293,806 | 11/293,805 | 11/293,810 |
| 09/575,197 | 09/575,195 | 09/575,159 | 09/575,123 | 6,825,945 | 09/575,165 | 6,813,039 |
| 6,987,506 | 09/575,131 | 6,980,318 | 6,816,274 | 09/575,139 | 09/575,186 | 6,681,045 |
| 6,728,000 | 09/575,145 | 09/575,192 | 09/575,181 | 09/575,193 | 09/575,183 | 6,789,194 |
| 6,789,191 | 6,644,642 | 6,502,614 | 6,622,999 | 6,669,385 | 6,549,935 | 09/575,187 |
| 6,727,996 | 6,591,884 | 6,439,706 | 6,760,119 | 09/575,198 | 6,290,349 | 6,428,155 |
| 6,785,016 | 09/575,174 | 09/575,163 | 6,737,591 | 09/575,154 | 09/575,129 | 6,830,196 |
| 6,832,717 | 6,957,768 | 09/575,162 | 09/575,172 | 09/575,170 | 09/575,171 | 09/575,161 |

The disclosures of these applications and patents are incorporated herein by reference.

BACKGROUND OF THE INVENTION

The inkjet printheads in the above cross referenced documents have an array of nozzles, each nozzle having an associated ink ejection actuator within a nozzle chamber. Ink from a cartridge or other reservoir is fed to the chambers where the ejection actuators force drops of ink through the nozzle for printing. As printers predominantly use removable cartridges, the invention will be described with specific reference to ink cartridges. However, it will be appreciated that the invention equally applies to any fluid reservoir for supplying a printhead.

During periods of inactivity, the ink is retained in the chambers by the surface tension of the ink meniscus that forms across the nozzle. If the meniscus bulges outwardly, it can 'pin' itself to the nozzle rim to hold the ink in the chamber. However, if it contacts paper dust or other contaminants on the nozzle rim, the meniscus can be unpinned from the rim and ink will leak out of the printhead through the nozzle.

To address this, many ink cartridges are designed so that the hydrostatic pressure of the ink at the nozzles is less than atmospheric pressure. This causes the meniscus across the nozzle openings to be concave or drawn inwards. Paper dust or other particulate contaminants are less likely to contact the meniscus when it is inverted into the nozzle. Furthermore, a positive pressure in the ink chamber helps to drive the flow of ink leaking from the chamber once the meniscus is compromised by paper dust.

The negative pressure in the chambers is limited by two factors. It can not be strong enough to de-prime the chambers (i.e. suck the ink out of the chambers and back towards the cartridge) and it must be less than the ejection pressure generated by the ejection drop ejection actuators. However, if the negative pressure is too weak, the nozzles can leak ink if the printhead is jolted or shaken. While this can happen during use, it is more likely to occur during the shipping and handling of the primed printheads.

To establish a negative pressure, some cartridges use a flexible bag design. Part of the cartridge has a flexible bag or wall section that is biased toward increasing the ink storage volume. U.S. Ser. No. 11/014,764 and U.S. Ser. No. 11/014,769 (listed above in the cross referenced documents) are examples of this type of cartridge. These cartridges can provide a reliable and constant negative pressure, but the design is relatively complex, bulky and costly to make. Also the ratio of ink used for printing, to the total volume of ink in the cartridge is typically low. Unless the cartridge is refillable, much of the ink is wasted when the cartridge is discarded.

Another way of generating a negative pressure in the ink chambers is shown in FIG. 1. A piece of foam or porous material 2 is placed in the cartridge 1 over the outlet 3. The foam 2 has a section that is saturated with ink 4, and a section 5 that may be wet with ink, but not saturated. The top of the cartridge 1 is vented to atmosphere through the air maze 7. Capillary action (represented by arrow 6) draws the ink from the saturated section 4 into the unsaturated section 5. This continues until it is balanced by the weight of the increased hydrostatic pressure, or 'head' of ink drawn upwards by the capillary action 6. The hydrostatic pressure at the top of the saturated section 4 is less than atmospheric because of capillary action into the unsaturated section 5. From there, the hydrostatic pressure increases towards the outlet 3, and if connected to the printhead (not shown), it continues to increase down to the nozzle openings (assuming they are the lowest points in the printhead). By setting the proportion of saturated foam to unsaturated foam such that the hydrostatic pressure of the ink at the nozzle is less than atmospheric, the ink meniscus will form inwardly.

This is a much simpler and cheaper design, but the amount of ink retained in the foam when the cartridge is discarded is still high. The need for an unsaturated section of foam, and the foam itself, makes the volumetric efficiency quite low, i.e. the ratio of ink volume to total cartridge volume is low. Furthermore, the negative pressure at the nozzle will increase as the ink level in the cartridge drops. As the negative pressure must be established at the nozzles when the cartridge is first installed, and the negative pressure increases as the ink in the cartridge is used, there are practical limits on the volume of ink that can be supplied by cartridges of this type. As previously discussed, the negative pressure at the nozzles can not be stronger than the ejection actuators or greater than the de-prime threshold.

One attempt to address this is schematically shown in FIG. 2. The cartridge 1 essentially has two chambers 8 and 9; one holding the foam 2 and the other holding ink 10 only. The chambers are connected by a narrow passage 11 at the floor 12 of the cartridge. The hydrostatic ink pressure below the balance line 13 is the same in each chamber for corresponding heights. The negative pressure in the sealed air space 14 above the ink in the second chamber 9 can be expressed as follows:

$$P_{air}=-(\rho.g.H+P_{foam})$$

Where:

ρ is the density of ink g is gravity

H is height above the balance line.

$P_{foam}$ is the pressure at the balance line under the influence of capillary action in the foam.

The negative pressure at the nozzles is provided by capillary action 6 to the unsaturated section of the foam 5. However, the foam 2, and therefore the printhead, is fed additional ink from the second chamber 9. As ink drains from the second chamber 9, tiny bubbles of air 15 form at the opening 11 and rise up to the head space 14. This arrangement is more volumetrically efficient but still suffers from many of the problems associated with the design shown in FIG. 1. A substantial amount of ink remains in the foam when the cartridge is discarded and the second chamber 9 introduces an extra degree of complexity for manufacturing and charging with ink.

The present Applicant has developed a range of pagewidth printheads for high speed, 1600 d.p.i. full color printing. High speed pagewidth printheads introduce additional problems for cartridges with foam inserts. Firstly, the cartridge is supplying a much greater number of nozzles than a scanning printhead. In a high speed printer (speeds greater than an A4 page per second) the nozzles have a higher firing rate. Therefore the ink flow rate out of the cartridge is much greater than that of a scanning printhead. The fluidic drag caused by the foam insert can starve the nozzles and retard the chamber refill rate. More porous foam will have less fluidic drag but also much less capillary force.

Secondly, pagewidth printheads have a generally elongate structure. By definition they must extend (at least) the width of a page. If one end of the printhead is raised during installation or shipping, the head of ink above the lower-most nozzles can be much greater than when the printhead is horizontal. This increase can overcome the negative pressure at the lower nozzles and cause leakage.

OBJECT OF THE INVENTION

The present invention aims to overcome or ameliorate at least one of these problems, or provide a useful alternative to the prior art.

SUMMARY OF THE INVENTION

Accordingly, the present invention provides an ink reservoir for an inkjet printhead, the reservoir comprising:

a container for maintaining a quantity of ink at a pressure less than ambient pressure;

an ink outlet for sealed fluid connection to the printhead, and, an air inlet with a pressure regulator that allows air into the container at a predetermined pressure difference between the container interior and atmosphere.

In some embodiments, the pressure regulator is a valve relief valve. In other embodiments, the pressure regulator is a porous member with a first surface for exposure to atmosphere and a second surface for contacting the ink in the container; wherein during use, air at the first surface moves to the second surface and forms bubbles.

Instead of generating the negative pressure in the cartridge with capillary action or biased flexible bags, the present invention uses the suction provided the printhead to drop the pressure in the cartridge to the desired negative pressure and then uses a pressure regulator at the air inlet to keep control the level of negative pressure. The regulator can be a valve member that allows air into cartridge at a specified pressure difference or it could also be porous material with a particular 'bubble point'. The term 'bubble point' is explained below.

Using a valve member, such as a simple pressure relief valve in the wall of the cartridge allows the negative pressure inside the cartridge to be closely controlled. By locating the valve so that it is slightly elevated relative to the ink outlet, the hydrostatic pressure of the ink at the outlet remains constant and so the pressure in the nozzles chambers is also constant (ignoring fluctuations from movement or jarring of the printhead).

The pressure valve can also provide a convenient point from which the initially charge the cartridge with ink. As discussed above, the nozzles of a pagewidth printhead generate relatively high suction on the cartridge so the threshold pressure difference can be relatively high. The pressure difference should at least be greater than 10 mm $H_2O$, but a more practical level would be greater than 300 mm $H_2O$. With a high pressure threshold, the negative pressure is strong enough to counter the higher hydrostatic pressures in the lowest nozzles if the printhead is ever angled or held vertically.

Even though the pressure relief valve can be relatively simple and inexpensive, a porous member with a suitable bubble point is an even simpler and cheaper form of pressure regulation. The bubble point of porous material is the air pressure applied to one side of the material in order form a bubble on another side that is immersed in ink. Obviously, the bubble point for a given porous material will vary depending on the type of gas and the type of liquid used. The porous material can be in the form of a membrane, mesh or open cell foam. In the case of foam, it is important to note that its function is not to provide any capillary action for generating negative pressure and therefore it is much denser and smaller than the foam inserts used in the prior art cartridges. A foam member used in the present invention absorbs and retains very little ink compared to the foam inserts of the prior art.

It will be appreciated that the porous membrane, mesh or foam member can be positioned toward the bottom of the cartridge to maintain a constant hydrostatic pressure at or near the ink outlet. Firing the nozzles will drop the pressure in the cartridge until the bubble point is reached. Continued firing of the nozzles does not further reduce the pressure as tiny air bubbles permeate through the membrane, mesh or dense foam member.

Very little ink is retained by the membrane, mesh or foam so the proportion of ink used for printing is much higher. Similarly, the whole cartridge can have a more compact design for a given quantity of ink. Furthermore, it is a simple matter to select a material with bubble point high enough to generate a negative pressure strong enough for pagewidth printheads. The Applicant's printheads generate about 1200 $mmH_2O$ nozzle ejection pressure (per color). Therefore, a membrane with a bubble point of approximately 300 $mmH_2O$ to 600 $mmH_2O$ is readily available and will generate a negative pressure strong enough to guard against leakage from inclining the printhead or mild jarring.

The cartridges have an increasing head space of air as the ink is used. If the internal surface of the air permeable member is exposed to the air in the cartridge it can dry out and become much more permeable to air. If this happens the cartridge will effectively vent to atmosphere and the negative pressure is lost. To safeguard against this, the internal surface of the permeable member must be kept wet. Some ways of achieving this are:

Using a foam element that absorbs and retains some ink;

Using a second membrane spaced from, but close to, the inner surface of the first membrane so that ink stays between the membranes, even if the cartridge is oriented so that the membranes are in the air of the headspace;

Providing the porous member in a wall of the cartridge and then a hydrophilic wall closely adjacent to the internal surface of the permeable member so that capillary action keeps the internal surface wet (and optionally, putting some wicking material or mesh between the hydrophilic and the internal surface); and, A series of internal baffles forming an ink trap or maze that maintains ink next to the internal surface.

In some embodiments of the invention, the air inlet also has an air maze structure so in the event that ink permeates through the air permeable material, it does not leak to the exterior of the cartridge. The ink outlet may have a filter covering to stop air bubbles from getting to the nozzles. However, the filter should not create a significant flow restriction for the ink. The outlet is not obstructed by a foam insert as it is in the prior art cartridges, and therefore cartridges according to the present invention can supply ink at a high flow rate. As previously discussed, high speed pagewidth printheads require high ink flow rates.

Other features and advantages of the present invention will become apparent from the following detailed description of preferred embodiments.

BRIEF DESCRIPTION OF THE DRAWINGS

Preferred embodiments of the invention will now be described, by way of example only, with reference to the accompanying drawings, in which.

DETAILED DESCRIPTION OF THE PREFERRED EMBODIMENTS

Figure 1:
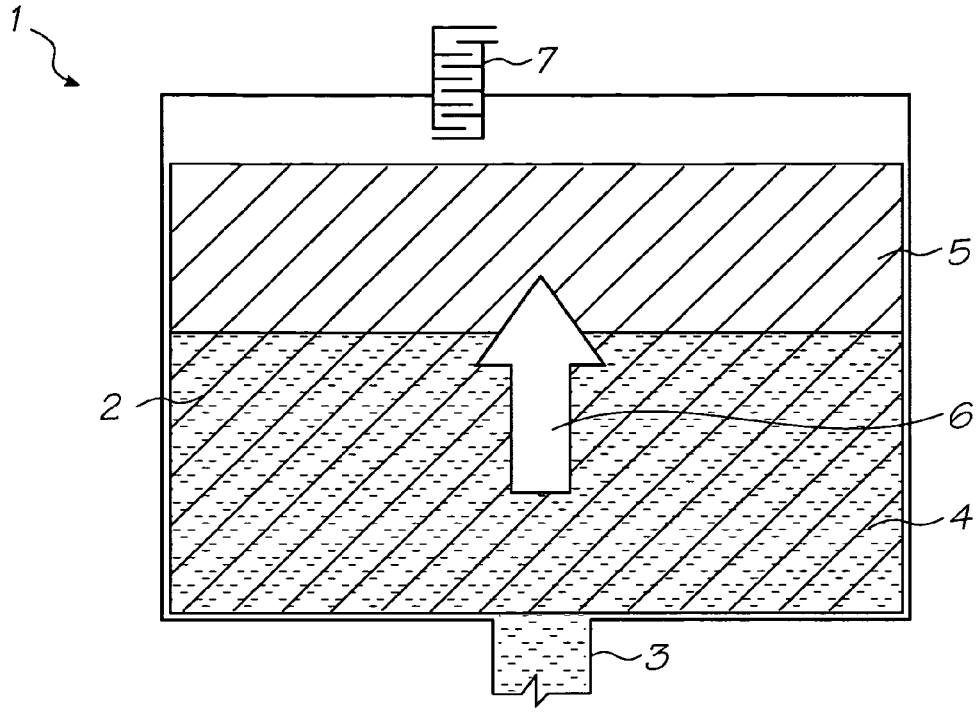
FIG. 1 (PRIOR ART)
FIG. 1 is a schematic section view of a prior art ink cartridge.
Figure 2:
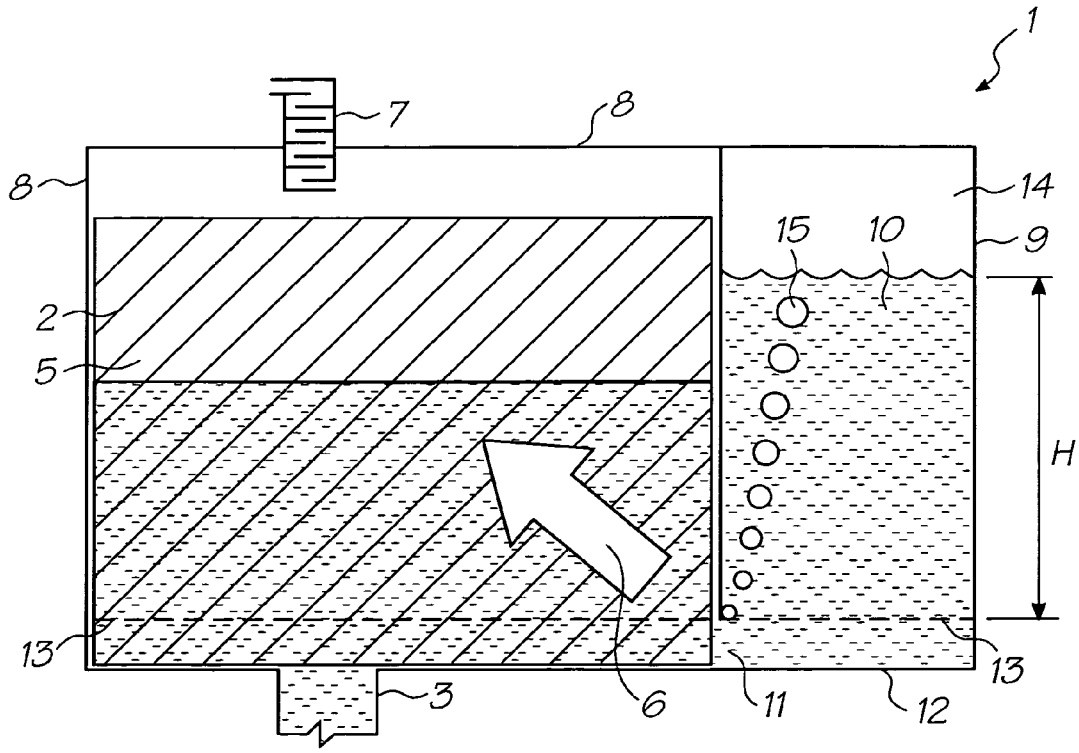
FIG. 2 (PRIOR ART)
FIG. 2 is a schematic section view of another prior art ink cartridge.
Figure 3:
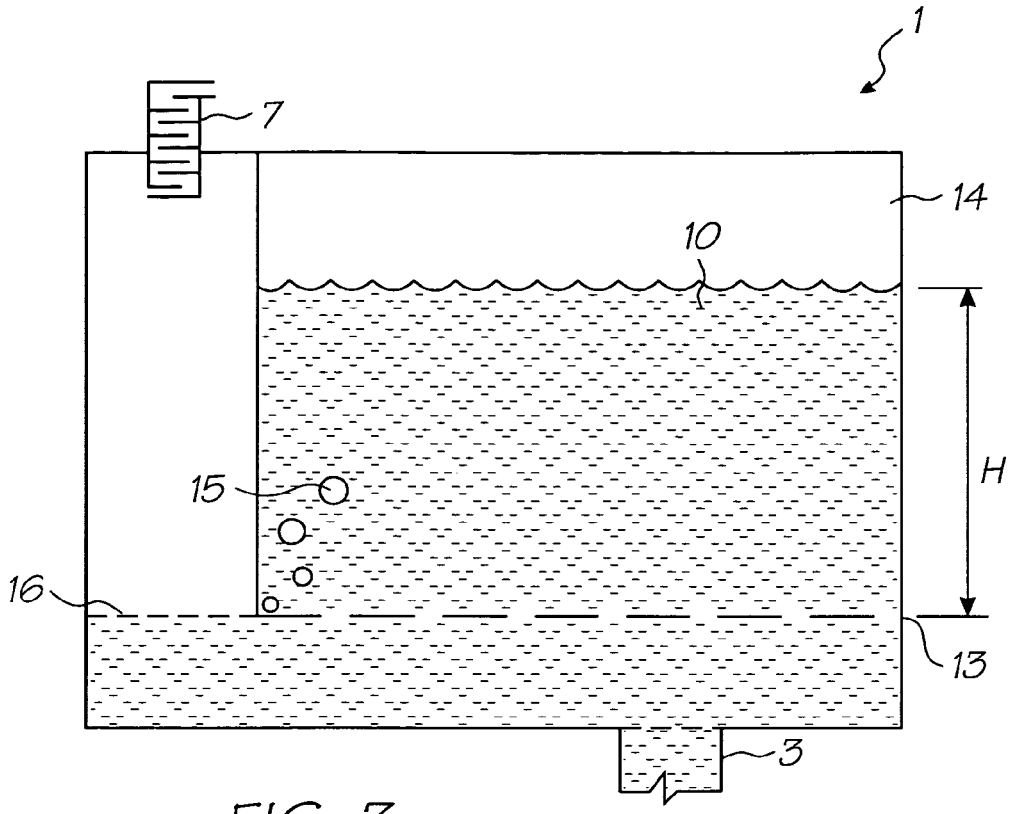
FIG. 3 is a schematic section view of an ink cartridge according to the present invention.

FIG. 3 is a simplified sketch of the invention to illustrate the basic operating principles. It uses a membrane 16 positioned near the floor 12 of the cartridge 1 to maintain a negative pressure at the control level 13. Unlike the prior art cartridges of FIG. 1 and 2, the hydrostatic pressure at the control level is set by the bubble point of the membrane. As previously discussed the bubble point of porous material is the gas pressure that needs to be applied to one side to force liquid from the largest wetted pore on the immersed side.

When the cartridge is installed, the nozzles can fire into a blotter or the like to lower the pressure in the cartridge. When the pressure at the control level 13 drops to the bubble point, small bubbles 15 will form on the internal surface of the membrane 16 and rise into the head space 14. This slightly increases the pressure in the cartridge and the bubbles 15 stop forming on the membrane 16. Once bubbles start forming on the inside of the membrane 16, the hydrostatic pressure at control level 13 is known. Likewise, if a different pressure regulator is used, once the printhead has initially established the required negative pressure, the control level 13 keeps a constant hydrostatic pressure (equal to the regulator threshold pressure).

As ink is consumed by the printhead, the negative pressure at the control level 13 (and therefore at the outlet 3) will remain effectively constant. Of course, if the ink level drops below the control level 13, the membrane 16 is no longer covered by ink and the cartridge vents to atmosphere. To avoid this, the printer should stop printing before the ink level reaches the control level. However, there are methods for keeping the membrane wet when it is exposed to the air of the headspace 14. These are discussed in detail below.

Figure 4:
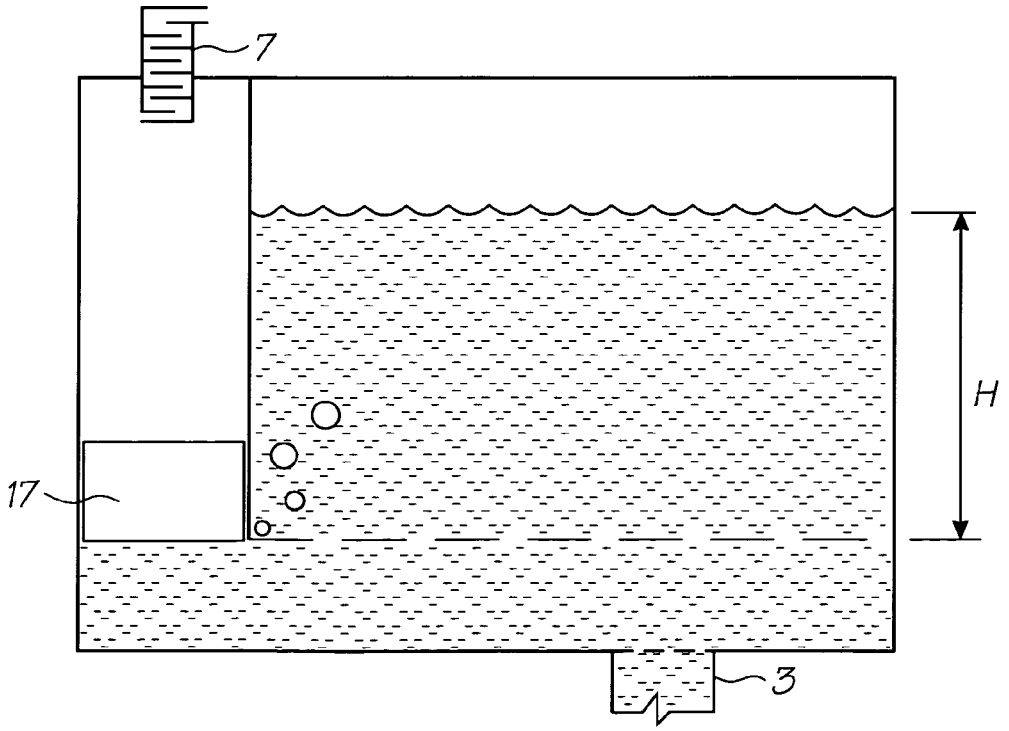
FIGS. 4 and 5 are partial schematic section views of alternatives to the ink cartridge shown in FIG. 3.

The embodiment shown in FIG. 4 uses a small block of dense open cell foam 17 instead of the membrane 16 of the previous embodiment. The bubble point of the foam sets the hydrostatic pressure at the control level 13 and the cartridge 1 operates in way as the membrane embodiment.

The foam is denser than that used in the prior art cartridges so that the bubble point is high enough to generate the required negative pressure. However, it absorbs some ink and will stay wet (temporarily at least) if it is exposed to the air in the headspace. It will be appreciated that the foam can be easily exposed to the air in the cartridge when the printhead is moved or transported.

In these embodiments of the invention, the air inlet 7 has an air maze structure. If ink happens to permeate through the porous material (membrane 16 in FIG. 3 and foam element 17 in FIG. 4), it does not leak to the exterior of the cartridge. The ink outlet 3 may have a filter 23 covering to stop air bubbles from getting to the nozzles. However, the filter should not create a significant flow restriction for the ink. The outlet 3 is not obstructed by a foam insert as it is in the prior art cartridges and so can supply ink at a high flow rate. As previously discussed, high speed pagewidth printheads require high ink flow rates.

Figure 5:
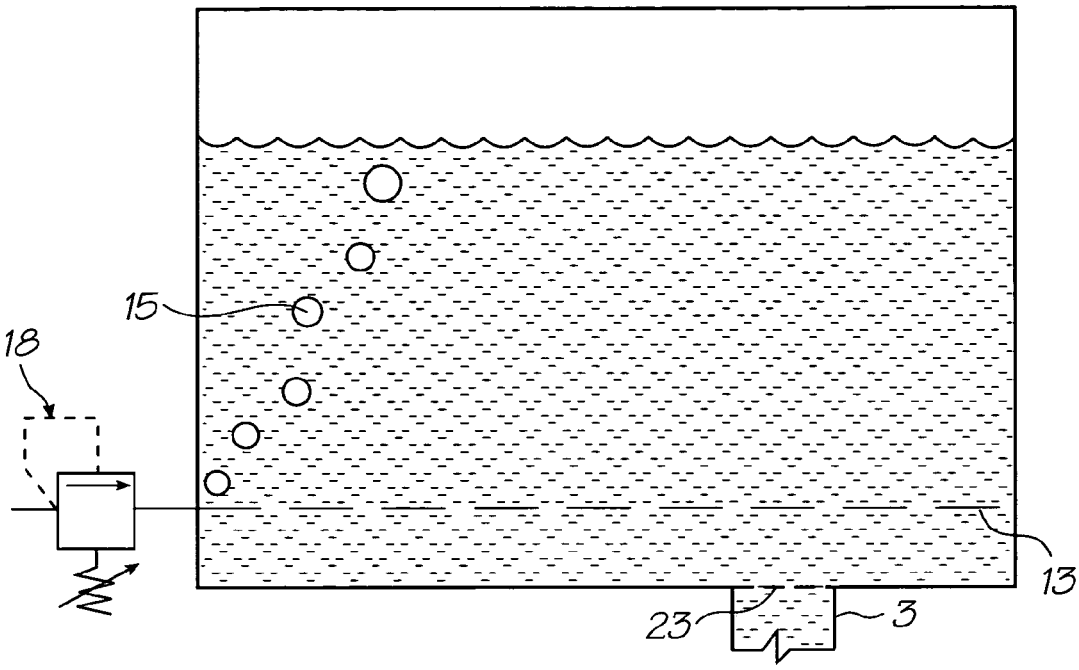

The embodiment shown in FIG. 5 is even simpler in the sense that it does not need an inlet air maze 7 or internal passage covered by a membrane, mesh or foam element. Instead, a pressure relief valve 18 in the wall of the cartridge opens at a threshold pressure which sets the hydrostatic pressure at the control level 13. Furthermore, if the internal side of the valve is exposed to the air in the cartridge, it does not vent to atmosphere like a dry membrane or foam. It opens when the pressure difference reaches the specified threshold and so maintains a negative pressure in the cartridge even after the ink has dropped below the control level 13 (although the pressure at the outlet 3 will slightly decrease as the level drops below the valve 18).

The pressure relief valve 18 can be a simple ball-type check valve that is biased into its seat to keep the unit cost to a minimum. It is unlikely to be cheaper than a membrane or foam element however it does provide a convenient means for initially charging the cartridges with ink and allows the cartridge to be very compact.

Figure 6:
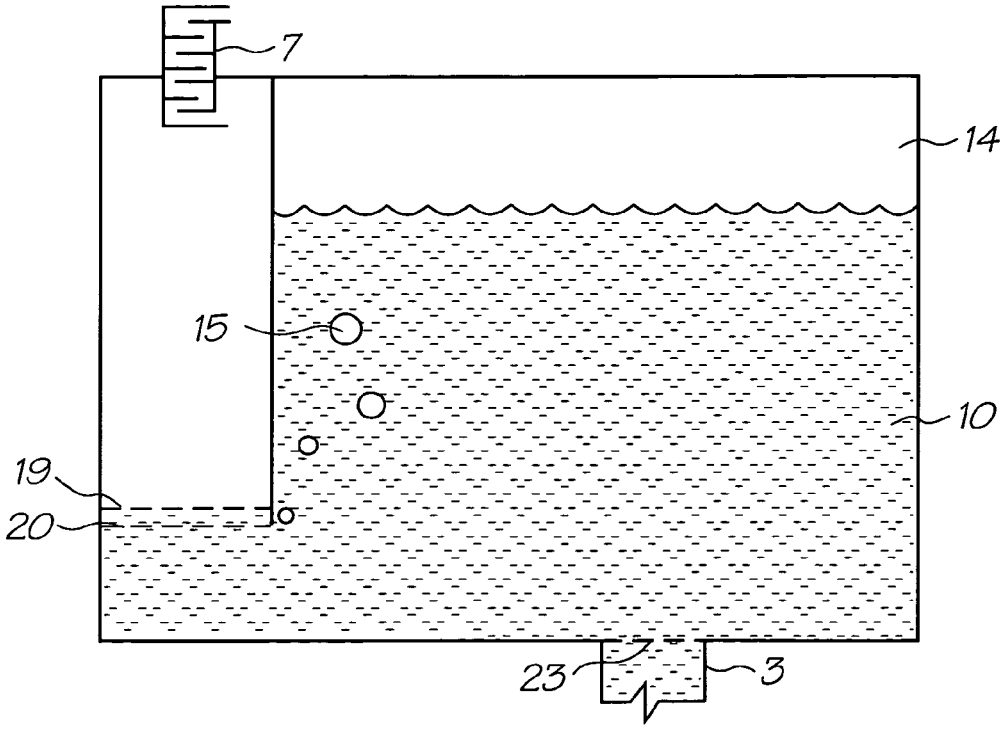
FIGS. 6 and 7 are schematic section views of a double membrane cartridge in different orientations.
Figure 7:
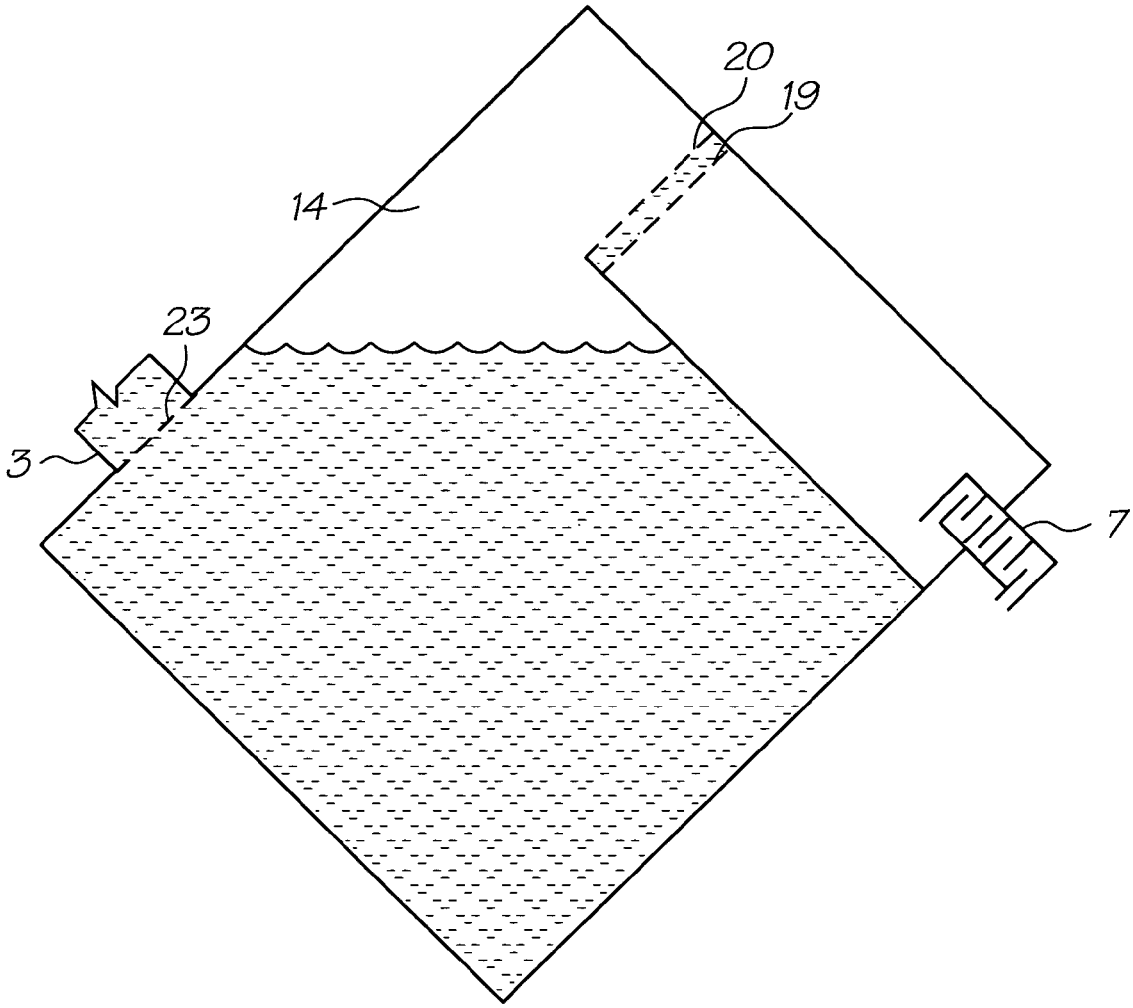

Returning to the membrane embodiment, FIGS. 6 and 7 show a solution to the problem of membrane drying discussed above. Instead of a single membrane, a pair of membranes 19 and 20 is used. The membranes are closely spaced so that the ink between them does not drain out if the cartridge is positioned such that they are in the air of the headspace 14 (see FIG. 7). As long as the internal surface of the outer membrane 19 stays wet, the cartridge 1 will not vent to atmosphere.

Figure 8:
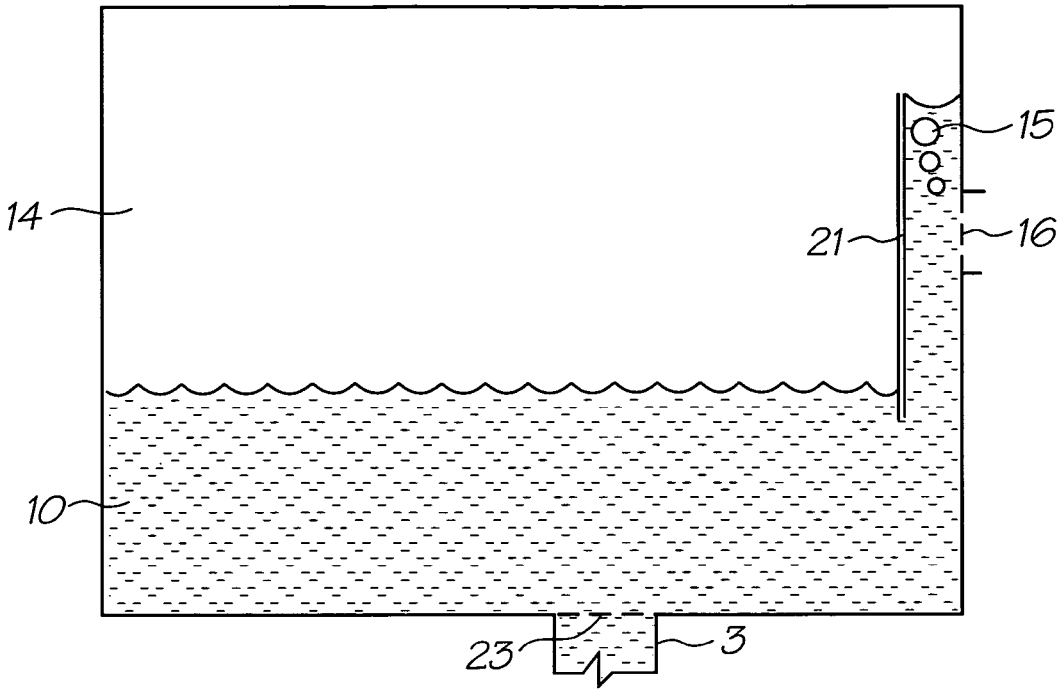
FIG. 8 is a schematic section view of a cartridge with single membrane and hydrophilic internal wall.
Figure 9:
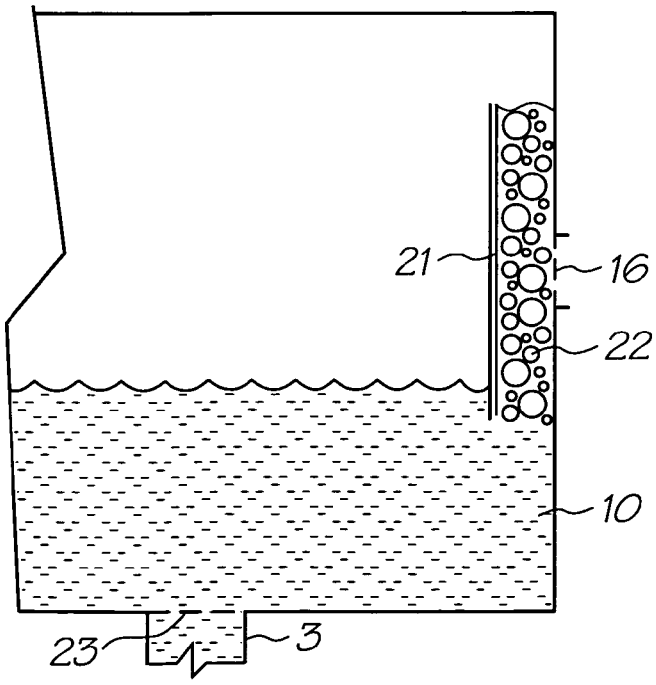
FIG. 9 is a partial schematic section view of an alternative to cartridge shown in FIG. 8; and, FIG. 10 is a schematic sectioned perspective of a cartridge according to the invention showing the possible configuration of the tortuous air inlet flow path.

FIGS. 8 and 9 show another version of the membrane embodiment that also avoids the membrane drying problem.

The cartridge of FIG. 8 has a membrane 16 in the wall of the cartridge 1. Closely adjacent the internal surface of the membrane 16 is an internal wall 21. For water based inks, the internal wall 21 should be approximately 1 mm away from the membrane. The internal wall 21 is made of a hydrophilic material so that ink is held between the wall and the membrane 16 by capillary action when the ink level drops below the membrane. The tiny air bubbles 15 permeating through the membrane 16 rise up through the ink held the wall 21 and into the air space 14.

In FIG. 9, wicking material 22 is placed between the wall 21 and the membrane 16 to enhance the capillary action. The wicking material can be fabric, mesh or particulate material. By enhancing the capillary action the ink level can drop further below the membrane before its internal surface dries out. The wicking material also damps any jolts or impacts to the printhead that might otherwise dislodge the ink from between the membrane 16 and the wall 21.

Cartridges according to the invention are particularly suited to use with the Applicant's range of pagewidth printheads. These printheads will typically generate 1200 mm.$H_2O$ of suction pressure per color which is much higher than that generated by a scanning type printhead. As the present invention uses the printhead to establish negative pressure in the cartridge, a strong suction allows the threshold pressure of the valve of air permeable material to be relatively high, which in turn allows a stronger negative pressure in the cartridge. A stronger negative pressure in the cartridge makes the nozzles less prone to leakage, particularly the lowest nozzles of a pagewidth printhead that is moved from it horizontal orientation. Furthermore, as discussed above, the unobstructed outlets allow a high ink flow rate to the nozzles.

Figure 10:
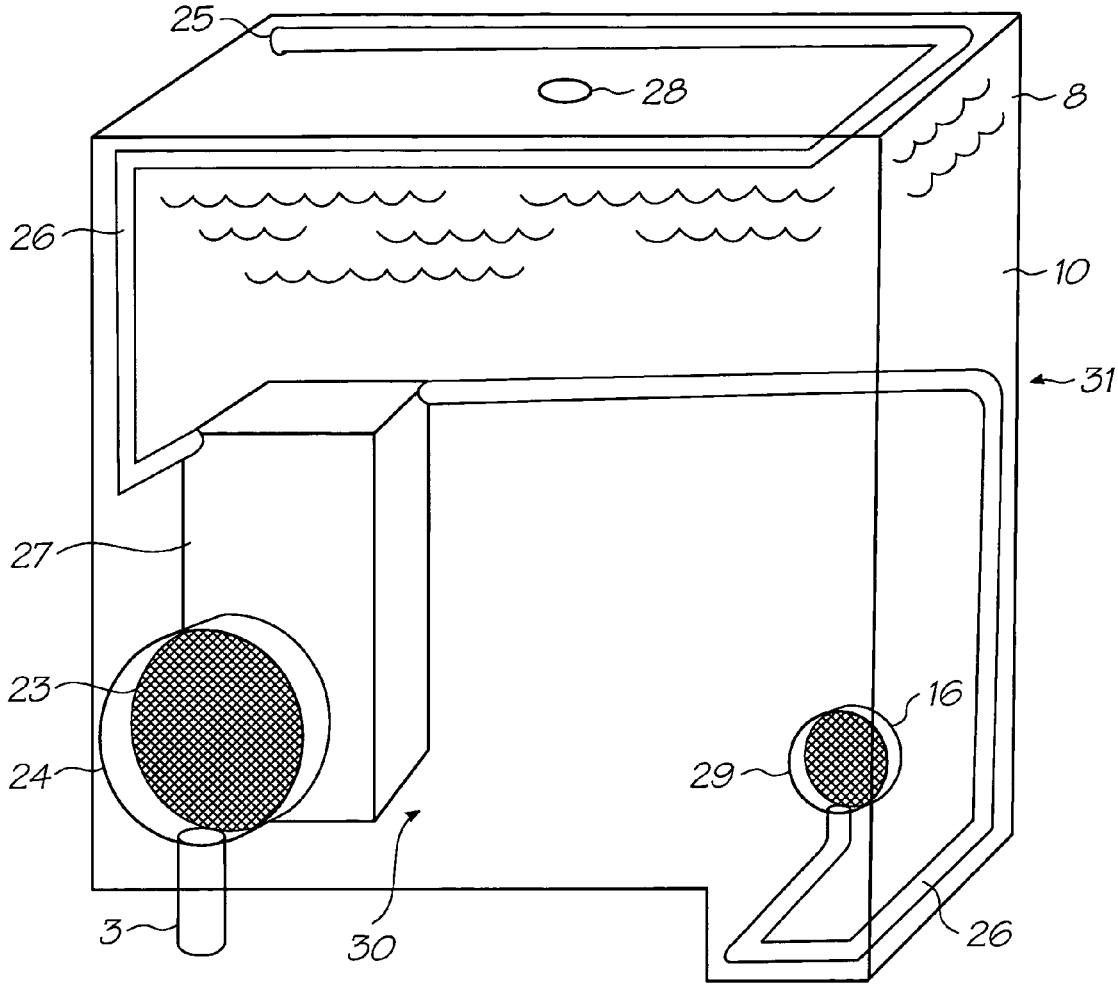

FIG. 10 shows how the air inlet maze might work in practice. The container 8 holds a quantity of ink 10 and encloses the inlet maze 26, the air expansion chamber 27, inlet membrane 16 and outlet filter 23. Inlet opening 25 is open to atmosphere and the outlet 3 forms a sealed fluid connection with the printhead when the cartridge is installed. The cartridge is filled through a sealable fill hole 28 in the top wall. The entire container 8 can be rigid or, parts of the container can be flexible material to lower materials costs. For example the large side walls 30 and 31 can be air and ink impermeable film sealed to the periphery of a rigid wall middle section.

The air inlet tube 26 follows a tortuous path to the membrane 16. The tortuous path has irregular changes in direction so that any ink seeping into the tube 26 is very unlikely to leak out of the inlet opening 25 even if the cartridge is rotated through different orientation during transport. For ink in the lower section of the tube 26 to reach the opening 25, the cartridge needs to go through a precise sequence of rotations in different directions. The risk of this happening by chance during transport and handling is negligible.

The air inlet tube 26 incorporates an air expansion chamber 27. The cartridge is expected to be exposed to a wide range of temperatures—approximately 35° C. Any ink trapped in the line 26 can be forced to the opening 25 by the increased air pressure. The air expansion chamber 27 is relatively large compared to the tube 26 and so has more capacity to accommodate an expanding gas.

The inlet membrane 16 and the associated-chamber 29 is smaller than that of the ink outlet (23 and 24 respectively). This accounts for the high rate of ink supply required by the pagewidth inkjet printheads whilst also filtering the ink that leaves through the outlet 3. The large diameter filter 23 and associated chamber 24 means that the filter surface area is high so that the filter can keep a small pore size to remove all detrimental contaminants, without being an undue flow constriction in the ink supply.

The tortuous air inlet path 26 and air expansion chamber 27 effectively prevent ink leakage during transport and handling, with minimal added complexity and cost. The membrane is at the floor of the cartridge so that the negative ink pressure at the outlet 3 will be the bubble point of the membrane regardless of the amount if ink 10 that has been consumed. Furthermore, the vast majority of the ink will be consumed before the membrane is exposed and vents the interior to atmosphere. At this point the cartridge needs to be replaced however, only a small amount of ink will remain in the cartridge when it is discarded.

These embodiments are merely illustrative and the skilled worker will readily recognize many variations and modifications that fall within the spirit and scope of the broad inventive concept.

We claim:

1. An ink reservoir for an inkjet printhead, the reservoir comprising:

a container for maintaining a quantity of ink at a pressure less than ambient pressure;

an ink outlet for sealed fluid connection to the printhead, and, an air inlet with a pressure regulator that allows air into the container at a predetermined pressure difference between the container interior and atmosphere;

wherein, the pressure regulator is a porous member with a first surface for exposure to atmosphere and a second surface for contacting the ink in the container: wherein during use, air at the first surface moves to the second surface and forms bubbles;

and, the porous member is a membrane in a side wall of the reservoir, the membrane being positioned closely adjacent an internal wall such that ink is held between the wall and the membrane by capillary action when the ink level drops below the membrane.

2. An ink reservoir according to claim 1 wherein the pressure regulator is a valve relief valve.

3. An ink reservoir according to claim 1 wherein the pressure regulator is slightly elevated relative to the ink outlet location.

4. An ink reservoir according to claim 3 wherein the air permeable material is a membrane.

5. An ink reservoir according to claim 1 wherein the porous member is a membrane.

6. An ink reservoir according to claim 1 wherein the porous member is a mesh.

7. An ink reservoir according to claim 1 wherein the porous member is an open cell foam block.

8. An ink reservoir according to claim 1 wherein the threshold pressure is greater than 10 mm.$H_2O$.

9. An ink reservoir according to claim 1 wherein the printhead is a pagewidth printhead and the threshold pressure is greater than 300 mm.$H_2O$.

10. An ink reservoir according to claim 1 wherein the porous member is a pair of opposed membranes spaced from each other such that ink is retained between them if they are placed in an air space within the reservoir.

11. An ink reservoir according to claim 1 wherein the internal wall is approximately 1 mm away from the membrane.

12. An ink reservoir according to claim 11 wherein the internal wall is made of a hydrophilic material.

13. An ink reservoir according to claim 12 further comprising wicking material between the wall and the membrane to enhance capillary action.

14. An ink reservoir according to claim 13 wherein the wicking material is fabric, mesh or particulate material.

15. An ink reservoir according to claim 1 further comprising a filter over the outlet.

16. An ink reservoir according to claim 1 wherein the reservoir is a removeable ink cartridge for installation into an inkjet printer.

17. An ink reservoir according to claim 1 wherein the ambient pressure is atmosphere.

18. An ink reservoir according to claim 1 wherein the air inlet further comprises a tortuous air flow path from atmosphere to the pressure regulator.

* * * * *